US007507014B1

(12) United States Patent
League et al.

(10) Patent No.: US 7,507,014 B1
(45) Date of Patent: Mar. 24, 2009

(54) CONTROLLED CAVITATION DEVICE WITH EASY DISASSEMBLY AND CLEANING

(75) Inventors: Richard D. League, Muskegon, MI (US); Derek E. Parker, Lyerly, GA (US)

(73) Assignee: Hydro Dynamics, Inc., Rome, GA (US)

( * ) Notice: Subject to any disclaimer, the term of this patent is extended or adjusted under 35 U.S.C. 154(b) by 331 days.

(21) Appl. No.: 11/462,880

(22) Filed: Aug. 7, 2006

Related U.S. Application Data

(60) Provisional application No. 60/705,752, filed on Aug. 5, 2005.

(51) Int. Cl.
*B01F 7/02* (2006.01)
*B01F 7/12* (2006.01)

(52) U.S. Cl. ..... 366/172.1; 366/305; 366/349

(58) Field of Classification Search ..... 366/64–66, 366/96–99, 262–265, 279, 302, 305, 349, 366/168.1, 285–286, 171.1–172.2; 99/348; 29/238, 239, 240; 122/26; 126/247
See application file for complete search history.

(56) References Cited

U.S. PATENT DOCUMENTS

| | | | | |
|---|---|---|---|---|
| 3,195,867 | A | * | 7/1965 | Mould, Jr. |
| 3,961,776 | A | * | 6/1976 | Sperrle |
| 5,143,699 | A | * | 9/1992 | Herter |
| 5,188,090 | A | | 2/1993 | Griggs |
| 5,385,298 | A | | 1/1995 | Griggs |
| 5,957,122 | A | | 9/1999 | Griggs |
| 6,250,791 | B1 | * | 6/2001 | Schneider |
| 6,386,751 | B1 | * | 5/2002 | Wootan et al. |
| 6,502,980 | B1 | * | 1/2003 | Ekstrom et al. |
| 6,627,784 | B2 | | 9/2003 | Hudson et al. |
| 7,316,501 | B2 | * | 1/2008 | Thoma |
| 2004/0232006 | A1 | | 11/2004 | Kazem |
| 2005/0042129 | A1 | | 2/2005 | Kazem |

(Continued)

FOREIGN PATENT DOCUMENTS

| | | |
|---|---|---|
| AU | 2001261823 A1 | 2/2005 |

(Continued)

*Primary Examiner*—Charles E Cooley
(74) *Attorney, Agent, or Firm*—Womble Carlyle Sandridge & Rice

(57) ABSTRACT

A controlled cavitation device for mixing and heating of fluids in industries where sanitary conditions must be maintained. The device is easily disassembled for thorough cleaning and then easily assembled for continued operation. All internal surfaces are devoid of angles and are polished to food industry standards to maintain sanitary operation. The controlled cavitation device includes a cylindrical bearing housing for supporting a drive shaft that extends through each end of the bearing housing. An interior end plate is mounted to a C-face mount adjacent to the bearing housing and has a plurality of threaded bores around a periphery. A rotor is mounted adjacent to the interior end plate on the C-face mount. A housing assembly includes a cylindrical housing wall and is mounted on a swing arm assembly that is secured in place adjacent to the rotor. The housing assembly is rotated about a pivot arm in a first direction to fully enclose the rotor during assembly and is rotated in an opposite direction to expose the rotor during disassembly. An exterior end plate is fixed to one end of the housing wall to form a flange for connecting the housing assembly to the interior end plate.

23 Claims, 3 Drawing Sheets

U.S. PATENT DOCUMENTS

| | | | |
|---|---|---|---|
| 2005/0067122 | A1 | 3/2005 | Kazem et al. |
| 2005/0087315 | A1 | 4/2005 | Donovan et al. |
| 2005/0150618 | A1 | 7/2005 | Kazem et al. |

FOREIGN PATENT DOCUMENTS

| | | | | |
|---|---|---|---|---|
| CA | 2115383 | A1 | | 8/1994 |
| EP | 0610914 | A1 | | 8/1994 |
| EP | 1289638 | B1 | | 7/2006 |
| JP | 62013959 | A | * | 1/1987 |
| WO | WO-01/87471 | A2 | | 11/2001 |
| WO | WO-2004/103911 | A1 | | 12/2004 |

* cited by examiner

CONTROLLED CAVITATION DEVICE WITH EASY DISASSEMBLY AND CLEANING

CROSS-REFERENCE TO RELATED APPLICATION

The present patent application is a formalization of a previously filed, provisional patent application entitled "Controlled Cavitation Mixing Device with Easy Disassembly and Cleaning," filed on Aug. 5, 2005 as U.S. patent application Ser. No. 60/705,752, by the inventors named in this patent application. This patent application claims the benefit of the filing date of the cited provisional patent application according to the statutes and rules governing provisional patent applications, particularly 35 USC § 119 (e)(1) and 37 CFR §§ 1.78(a)(4) and (a)(5). The specification and drawings of the provisional patent application are specifically incorporated herein by reference.

FIELD OF THE INVENTION

The present invention relates generally to devices for heating fluids and mixing dissimilar fluids using controlled cavitation and more specifically to such controlled cavitation devices that can be disassembled, cleaned, and reassembled easily.

BACKGROUND OF THE INVENTION

The mixing and heating of fluids using controlled cavitation devices are known. The following U.S. patents and patent applications owned by the assignee of the present application teaches various aspects of a particularly successful controlled cavitation device for such purposes:

U.S. Pat. Nos. 5,188,090; 5,385,298; 5,957,122; 6,627,784

U.S. patent application Ser. Nos. 10/618,119; 10/843,104; 09/919,064; 10/932,604; 11/062,534; 60/654,387.

All of the disclosures and teachings of these patents and patent applications are hereby incorporated into this disclosure by reference as if fully set forth herein.

The devices disclosed in the aforementioned patents and patent applications have proven extremely efficient and useful for heating fluids and mixing dissimilar fluids. For certain heating and mixing applications, however, the devices disclosed have been found to exhibit certain shortcomings. For example, when heating and mixing fluids in the food processing industry, stringent sanitary and cleanliness requirements must be met. This means that the machinery used in the food processing industry (and other industries where stringent sanitary standards are enforced) must be able to be cleaned and thoroughly sanitized on a regular basis. Prior art controlled cavitation devices disclosed in the incorporated references can be disassembled, but such disassembly requires laborious, tedious, and time consuming efforts and generally requires special tools and an engineer or technician that is significantly skilled in the operation and maintenance of the device. This is not desirable for industries such as the food processing industry, which expect machines used for processing food to be able to be disassembled, cleaned, and reassembled quickly, easily, and by low-skilled food processing personnel. Thus, a need exists for a highly efficient controlled cavitation fluid heating and mixing device that meets this expectation so that its great efficiency can be exploited in industries such as food processing where easy and frequent cleaning of the device is required. It is to the provision of such a device that the present invention is primarily directed.

SUMMARY OF THE INVENTION

Briefly described, the present invention, in one exemplary embodiment thereof, comprises a controlled cavitation device that can be disassembled, cleaned, and reassembled quickly and easily by relatively unskilled personnel. The configuration of the device is similar in many respects to the device disclosed in U.S. Pat. No. 5,957,122, which is incorporated by reference. Generally, the device includes a cylindrical rotor mounted on a shaft and disposed in a generally cylindrical housing. An electric motor or other motive means is coupled to the shaft (or the shaft can be an extension of the shaft of the motor itself). When the motor is activated, it spins the rotor at relatively high rotational speeds within its housing.

The rotor is provided on its outer periphery with a plurality of discontinuities, preferably in the form of an array of holes drilled into the rotor. Fluid to be heated or mixed is pumped through the space between the outer peripheral surface of the rotor and the cylindrical wall of the housing. As the rotor turns, violent cavitation events are induced in the fluid in the regions of the holes. The energy released by this cavitation heats the fluid and, where two fluids are introduced, has a wide variety of desirable effects including highly efficient mixing of the fluids, efficient inducement of chemical reactions within the fluids, and many others. Such effects are disclosed and discussed in detail in the patents and patent applications incorporated by reference.

In addition to the benefits of the devices and methods in the incorporated references, the present application provides structure and methodology for disassembling a controlled cavitation device easily for cleaning, and then easily reassembling the device for use. Generally, this is accomplished through a uniquely designed rotor housing assembly. The rotor housing generally is formed by a cylindrical peripheral wall that is capped on its ends by disc-shaped end plates. The end plates have a larger diameter than the wall so that a mounting flange is formed by the radially projecting edge portions of the end plates. The inboard end plate (i.e., the one closest to the motor) is mounted on and is a part of the support structure connected to the bearing housing. The rotor shaft extends through bearings in this end plate to be coupled through a bearing housing to the motor.

The outboard end plate is secured to the cylindrical wall. An array of bolts extends through the flange of the outboard end plate and is positioned therearound. The subassembly formed by the outboard end plate and the cylindrical wall is mounted to the inboard end plate to form the closed housing that encloses the rotor. Specifically, this subassembly is moved over the rotor and the bolts extending through its peripheral flange are threaded into threaded bores in the peripheral edge portion of the inner plate, thereby securely bolting the housing assembly together.

In the present invention, each bolt of the array of bolts used to secure the housing components together is provided with a hand knob on the outboard end plate in order to reduce the use of tools in the disassembly process, which is highly desired in the food processing industry. The subassembly comprising the outboard end plate and cylindrical wall of the housing is mounted on a swing arm located adjacent to the device. This allows the subassembly to be swung out of the way when disconnected so that it, and the then exposed rotor assembly, can be thoroughly cleaned. Afterwards, the swing arm allows the subassembly to be swung back into place easily and secured to the inboard end plate. Alignment pins or dowels are provided in the inside edge of the cylindrical wall and corresponding holes are provided in the inside plate. When the subassembly is properly aligned with the inside plate, the alignment pins register with the holes to position the subassembly properly before it is bolted in place. An O-ring in the edge of the cylindrical wall forms a seal against the inboard end plate to seal the interior of the housing.

BRIEF DESCRIPTION OF THE DRAWINGS

These and other advantages and aspects of the present invention will become apparent and more readily appreciated from the following detailed description of the invention taken in conjunction with the accompanying drawings, as follows.

DETAILED DESCRIPTION OF THE INVENTION

The following description of the invention is provided as an enabling teaching of the invention and its best, currently known embodiment. Those skilled in the art will recognize that many changes can be made to the embodiments described while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations of the invention are possible and may even be desirable in certain circumstances and are part of the present invention. Thus, the following description is provided as illustrative of the principles of the invention and not in limitation thereof since the scope of the present invention is defined by the claims.

Figure 1:
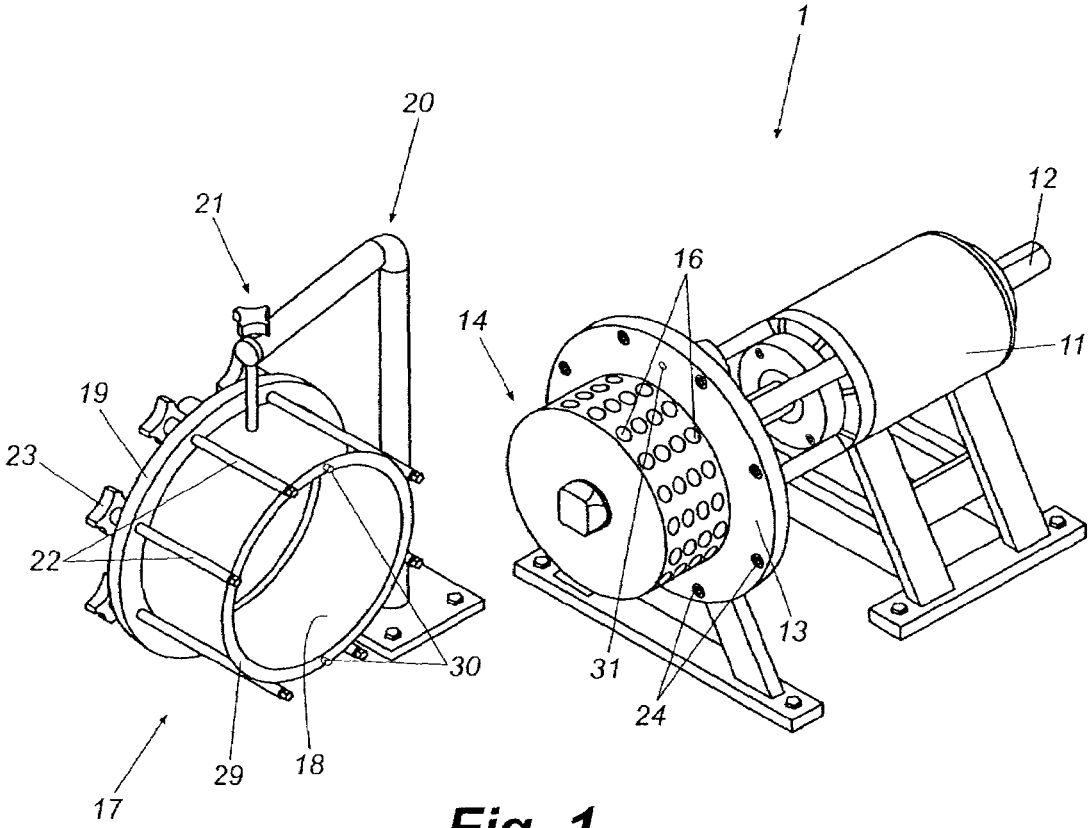
FIG. 1 illustrates a perspective view of the controlled cavitation mixing device in an exemplary embodiment of the invention.

Referring now in more detail to the drawing figures, wherein like reference numerals refer, where appropriate, to like parts throughout the several views, FIG. 1 illustrates most of the details of the controlled cavitation mixing device in an exemplary embodiment of the invention. As shown in FIG. 1, the mixing device 1 comprises a bearing housing 11 that rotatably supports a drive shaft 12. An inboard faceplate 13 is mounted to the bearing housing 11 with an appropriate bracket and the drive shaft extends through another bearing in the inboard faceplate to a free end portion. A cylindrical rotor 14 is secured to the free end portion of the drive shaft adjacent the inboard end plate and the rotor is formed with arrays of holes or bores 16 around its outer surface, as described in more detail in the incorporated references. Rotation of the drive shaft 12 by an electric motor (not shown) causes corresponding rotation of the rotor 14.

A housing subassembly 17 comprises a cylindrical housing wall 18 capped and sealed on one end by an outside or outboard end plate 19. The outboard end plate 19 (as well as the inboard end plate) is radially larger than the cylindrical wall 18, thus forming a peripheral flange 19 extending around the subassembly. An array of bolts 22 extend through holes in the flange 19 as shown and each bolt has an integral hand knob 23 by which it may be manually rotated. The flange formed by the inboard end plate 13 is provided with a corresponding array of threaded bores 24. When the subassembly 17 is moved over the rotor 14 and into contact with the inboard end plate 13, the bolts 22 are manually threaded by means of the hand knobs 23 into the threaded bores 24 to secure the housing subassembly 17 to the inboard end plate 13, thus forming a closed housing for the rotor.

A pair of alignment or locating pins or dowels 30 project axially from the end of the cylindrical wall 18 and these align with and extend into corresponding alignment holes 31 in the inboard end plate to ensure proper alignment before the bolts are tightened. Further, a flexible O-ring is embedded within an annular groove in the end of the housing subassembly and forms a secure seal with the inboard end plate when the two are bolted together. The housing subassembly is mounted on a custom swing arm assembly 20 that is secured in place adjacent to the rotor. More specifically, a rotating or pivoting pin 21 connects the subassembly 17 to the end of the pivot arm so that the housing subassembly is free to rotate about a vertical axis as well as be swung in an arc with the pivot arm. It will be appreciated that, with the forgoing configuration and arrangement of components, the housing subassembly can be disconnected easily and then swung conveniently out of the way on its swing arm assembly.

When the housing subassembly is disconnected and swung to the side, the rotor and housing interior surfaces are fully exposed so that they can be cleaned thoroughly, as is required in the food processing industry. To facilitate further the cleaning process, at least the interior stainless steel surfaces that contact food are polished to food grade specifications to inhibit growth of bacteria and the like and to prevent entrapment of food and contamination within discontinuities. Further, the holes in the rotor periphery surface, which actually create the cavitation events, are somewhat different than in the embodiments of the incorporated references. Specifically, the bottoms of the holes, rather than being flat or angled as in prior embodiments, are smoothly rounded and polished so that no abrupt intersections are formed. In fact, all internal angles of less than 135° have been eliminated in the present invention or have been formed with the proper radius as specified by 3-A sanitary standards for the purpose of eliminating nooks and crannies. Further, all internal surfaces are polished to an RA 32 (microinch) finish or better, according to the recommendations in ANSI/ASME B 46.1—Surface Texture. The elimination of internal angles and polishing of internal surfaces eliminates the buildup of contamination, encrusted food, and bacteria at such locations.

Figure 2:
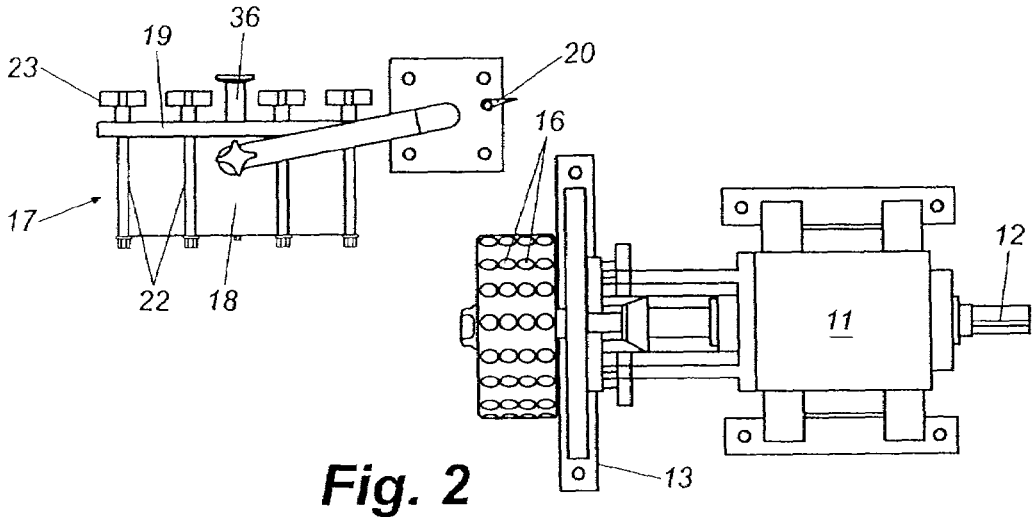
FIG. 2 illustrates a top view of the controlled cavitation mixing device in an exemplary embodiment.
Figure 3:
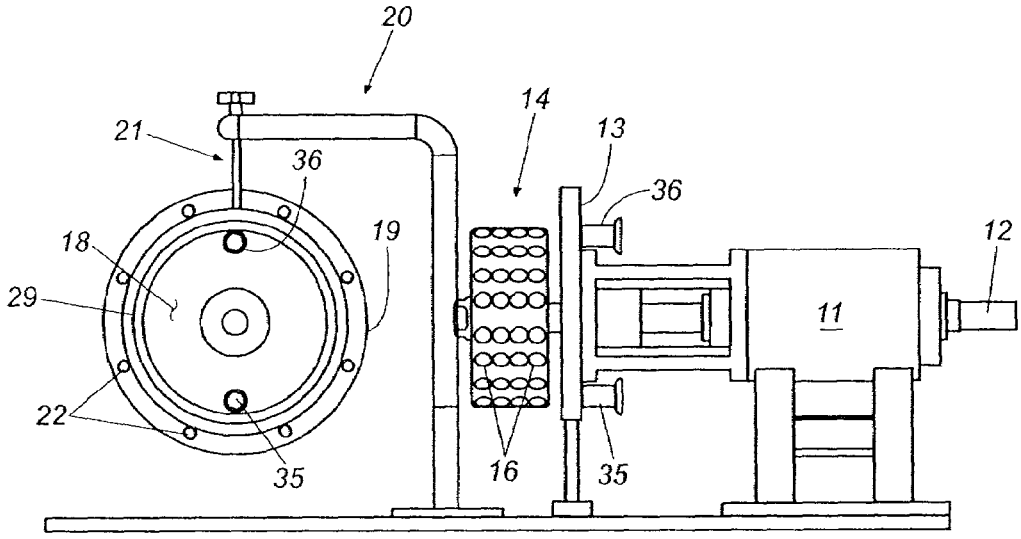
FIG. 3 illustrates a side view of the controlled cavitation mixing device in an exemplary embodiment.
Figure 4:
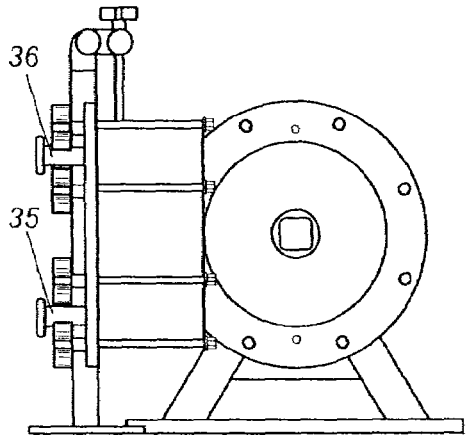
FIG. 4 illustrates an end view of the controlled cavitation mixing device in an exemplary embodiment looking back toward the rotor and motor assembly.

Referring to FIG. 2, hand knobs are also provided in place of traditional hexagonal bolts for securing and removing the inboard end plate to its mounting bracket. These hand knobs provide for easy disassembly for periodic and more thorough cleaning of the device where the rotor and inboard end plate are to be removed. This may occur, for instance, when the bearings in the end plate require cleaning or maintenance. As also shown in FIGS. 2 through 4, inlet ports 35 are provided near the bottom of each end plate and outlet ports 36 are provided near the top of each end plate. This symmetrical arrangement of inlet and outlet ports insures steady and balanced flow of fluid through the device and also eliminates unbalanced hydrodynamic pressures created by the inflow and outflow of fluid.

Figure 5:
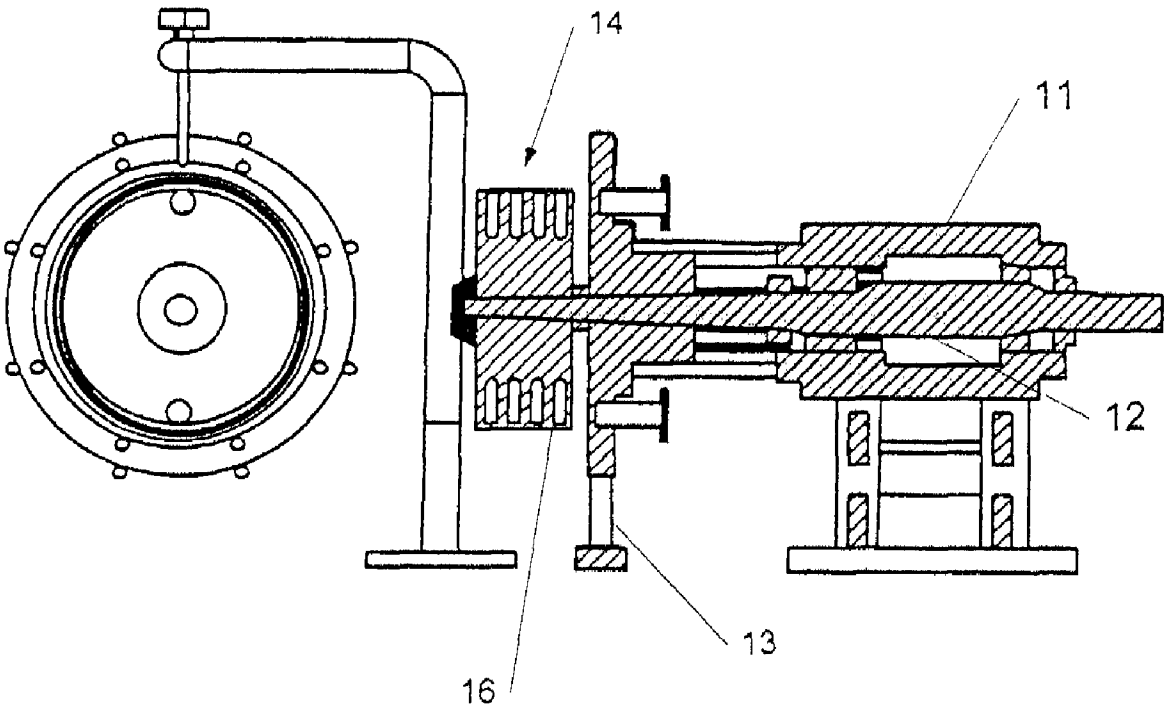
FIG. 5 illustrates a cross-sectional view of the exemplary controlled cavitation mixing device with the housing assembly in an open position.

FIG. 5 illustrates a cross-sectional view of the controlled cavitation mixing device with the housing assembly in an open position. This view shows the rotor 14 secured to the bearing housing 11 adjacent end plate 13. The openings or holes 16 positioned on the outer surface of the rotor 14 are uniquely rounded at the bottom end to prevent contamination and entrapment of food items. The figure also depicts specially tapered bores for the shaft 12 and rotor 14.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiment are possible without departing from the spirit and scope of the present invention for a controlled cavitation device that is easily disassembled and cleaned for use in sanitary applications such as in the food industry. In addition, it is possible to use some of the features of the present invention without the corresponding use of the other features. Accordingly, the foregoing description of the exemplary embodiment is provided for the purpose of illustrating the principles of the present invention and not in limitation thereof since the scope of the present invention is defined solely by the appended claims.

What is claimed:

1. A controlled cavitation device comprising:

a cylindrical bearing housing for supporting a drive shaft that extends through each end of the bearing housing;

an interior end plate mounted adjacent to the bearing housing and having a plurality of threaded bores around a periphery;

a rotor mounted adjacent to the interior end plate;

a housing assembly including a cylindrical housing wall mounted on a swing arm assembly including a pivot arm and secured in place adjacent to the rotor, wherein the housing assembly is rotated about the pivot arm in a first direction to fully enclose the rotor during assembly and is rotated in an opposite direction to expose the rotor during disassembly; and an exterior end plate fixed to one end of the housing wall to form a flange for connecting the housing assembly to the interior end plate.

2. The controlled cavitation device of claim 1 wherein the exterior end plate has a plurality of openings for accepting a plurality of bolts to secure the housing assembly over the rotor to the interior end plate.

3. The controlled cavitation device of claim 2 further comprising a plurality of bolts, each bolt including an integral hand knob, the bolts extending through the plurality of openings in the exterior end plate and into a corresponding plurality of threaded bores in the interior end plate.

4. The controlled cavitation device of claim 3 further comprising an alignment pin extending axially from a surface on an interior end of the housing assembly for insertion into a corresponding opening in the interior end plate, the alignment pin facilitating an accurate alignment of the housing assembly when positioned over the rotor.

5. The controlled cavitation device of claim 4 further comprising a flexible O-ring that is embedded in an annular groove in the interior end of the housing assembly to form a seal with the interior end plate when the interior and exterior end plates are bolted together.

6. The controlled cavitation device of claim 1 further comprising a pivot pin to connect the housing assembly to an end of the pivot arm, the housing assembly being free to rotate about a vertical axis and to swing in an arc with the pivot arm.

7. The controlled cavitation device of claim 1 wherein the rotor comprises a plurality of shaped openings on an outer surface to generate a cavitation mixing of fluids during the mixing operation.

8. The controlled cavitation device of claim 7 wherein the plurality of shaped openings are rounded on a bottom interior surface to avoid entrapment of mixed fluids during the mixing operation.

9. The controlled cavitation device of claim 7 wherein the plurality of shaped openings are rounded on a bottom interior surface to ensure all internal surface angles exceed 135 degrees.

10. The controlled cavitation device of claim 7 wherein all internal surfaces in the plurality of shaped openings are polished to meet food industry sanitary standards.

11. The controlled cavitation device of claim 1 further comprising an inlet port and an outlet port on both the interior and exterior end plates, each input port and outlet port located at diametrically opposite positions on each end plate to ensure a steady and balanced flow of fluids through the mixing device.

12. The controlled cavitation device of claim 1 further comprising a C-face mount attached to an end of the bearing housing for securing the interior end plate and rotor.

13. The controlled cavitation device of claim 12 wherein the interior end plate is secured to the C-face mount by bolts with integral hand knobs.

14. A controlled cavitation device comprising:

a bearing housing for supporting a drive shaft and having a C-face mount attached on one end;

an interior end plate secured to the c-face mount and having a plurality of threaded bores;

a rotor mounted adjacent to the interior end plate and secured to the C-face mount;

a housing assembly including a cylindrical housing wall mounted on a swing arm assembly including a pivot arm and secured in place adjacent to the rotor, wherein the housing assembly is rotated about the pivot arm in a first direction to fully enclose the rotor during assembly and is rotated in an opposite direction to expose the rotor during disassembly; and an exterior end plate fixed to one end of the housing wall to form a flange for connecting the housing wall to the interior end plate.

15. The controlled cavitation device of claim 14 further comprising a plurality of bolts, each bolt including an integral hand knob and extending through an opening in the exterior end plate and into a corresponding threaded bore in the interior end plate.

16. The controlled cavitation device of claim 15 further comprising an alignment pin extending axially from a surface on an interior end of the housing assembly for insertion into a corresponding opening in the interior end plate, the alignment pin facilitating an accurate alignment of the housing assembly when positioned over the rotor.

17. The controlled cavitation device of claim 16 further comprising a flexible O-ring that is embedded in an annular groove in the interior end of the housing assembly to form a seal with the interior end plate when the interior and exterior end plates are bolted together.

18. The controlled cavitation device of claim 14 further comprising a pivot pin to connect the housing assembly to an end of the pivot arm, the housing assembly being free to rotate about a vertical axis and to swing in an arc with the pivot arm.

19. The controlled cavitation device of claim 14 wherein the rotor comprises a plurality of shaped openings on an outer surface to generate a cavitation mixing of fluids during the mixing operation.

20. The controlled cavitation device of claim 19 wherein the plurality of shaped openings are rounded on a bottom interior surface to avoid entrapment of mixed fluids during the mixing operation.

21. The controlled cavitation device of claim 19 wherein the plurality of shaped openings are rounded on a bottom interior surface to ensure all internal surface angles exceed 135 degrees.

22. The controlled cavitation device of claim 14 further comprising an inlet port and an outlet port on both the interior and exterior end plates, each input port and outlet port located at diametrically opposite positions on each end plate to ensure a steady and balanced flow of fluids through the mixing device.

23. The controlled cavitation device of claim 14 wherein the interior end plate is secured to the C-face mount by bolts with integral hand knobs.

* * * * *